US007351099B1

(12) United States Patent
Amidon

(10) Patent No.: US 7,351,099 B1
(45) Date of Patent: Apr. 1, 2008

(54) STEP UP PIN FOR COAX CABLE CONNECTOR

(75) Inventor: Jeremy Amidon, Marcellus, NY (US)

(73) Assignee: John Mezzalingua Associates, Inc., East Syracuse, NY (US)

( * ) Notice: Subject to any disclaimer, the term of this patent is extended or adjusted under 35 U.S.C. 154(b) by 0 days.

(21) Appl. No.: 11/520,346

(22) Filed: Sep. 13, 2006

(51) Int. Cl.
*H01R 9/05* (2006.01)

(52) U.S. Cl. ..... 439/578; 439/583

(58) Field of Classification Search ..... 439/578, 439/583, 584, 585, 320
See application file for complete search history.

(56) References Cited

U.S. PATENT DOCUMENTS

| | | | | |
|---|---|---|---|---|
| 3,213,404 | A * | 10/1965 | Lars | 439/425 |
| 4,613,199 | A | 9/1986 | McGeary | |
| 4,666,230 | A | 5/1987 | Gartzke | |
| 4,672,342 | A | 6/1987 | Gartzke | |
| 4,957,454 | A | 9/1990 | Shichida | |
| 4,981,445 | A | 1/1991 | Bacher et al. | |
| 5,217,391 | A | 6/1993 | Fisher, Jr. | |
| 5,498,175 | A | 3/1996 | Yeh et al. | |
| 5,769,662 | A * | 6/1998 | Stabile et al. | 439/578 |
| 5,957,724 | A | 9/1999 | Lester | |
| 6,863,565 | B1 | 3/2005 | Kogan et al. | |
| 7,053,750 | B2 * | 5/2006 | Dascher | 338/329 |
| 7,144,272 | B1 * | 12/2006 | Burris et al. | 439/578 |
| 7,153,159 | B2 * | 12/2006 | Burris et al. | 439/578 |
| 2003/0143887 | A1 * | 7/2003 | Rehmann et al. | 439/358 |
| 2005/0176292 | A1 | 8/2005 | Lee et al. | |
| 2005/0233636 | A1 * | 10/2005 | Rodrigues et al. | 439/578 |
| 2005/0277330 | A1 * | 12/2005 | Kisling et al. | 439/578 |
| 2006/0014425 | A1 * | 1/2006 | Montena | 439/578 |

FOREIGN PATENT DOCUMENTS

| | | |
|---|---|---|
| FR | 2 570 227 | 3/1986 |
| GB | 2 264 400 | 8/1993 |

* cited by examiner

*Primary Examiner*—Hien Vu
(74) *Attorney, Agent, or Firm*—Hiscock & Barclay, LLP

(57) ABSTRACT

The invention provides a coaxial cable connector having a step up pin that engages the center conductor of a coax cable to increase the diameter of the center conductor to thereby make it more manageable. The pin is stored with the connector until the pin and connector are affixed to a coax cable.

7 Claims, 11 Drawing Sheets

STEP UP PIN FOR COAX CABLE CONNECTOR

FIELD OF THE INVENTION

This invention relates to coaxial cable connectors that engage the center conductor and the outer conductor of an end of a coaxial cable.

BACKGROUND OF THE INVENTION

A coax cable connector is generally used to provide a simple connection to an externally threaded coax receptacle or jack. The connector contacts the outer conductor of the cable in order to conduct the outer conductor signal to the jack. The center conductor of the cable passes through the center of the connector to engage the center hole of the jack. A dielectric portion between the components of the connector that contact the center conductor and the outer conductor isolates the signals. In some cases, such as with miniature coaxial cable, the center conductor is too small to engage the center hole of the jack fully for good conduction of the center conductor signal. A step up pin may be applied to the end of the center conductor to increase the diameter of the center conductor; however, step up pins are conventionally difficult to manage, are easily lost, and may be difficult to apply to the center conductor. In some cases, the pin might be a fixed part of the connector. It is difficult to line up the center conductor of the coax cable with the pin in this case because the user cannot see the opening of the axial bore of the pin.

A number of U.S. patents are directed to coax cable connectors including U.S. Pat. No. 4,613,199 issued to McGeary. McGeary teaches a coaxial cable connector having a captive inner pin contact. The connector includes a tubular main body that is crimped over the cable braid of a coaxial cable. A crimp ring is provided inside the rear end of the tubular main body and secures the cable braid of the coaxial cable against a ferrule which is inserted between the cable braid and the cable dielectric prior to crimping. A cylindrical contact insulator is secured inside the front end of the tubular main body, separates the inner pin contact from the front end of the tubular main body, and secures the inner pin contact in combination with the insulator ring and ferrule. Threads are provided on the inside surface of the ferrule to hold the ferrule in position during crimping, to help provide positive contact to the tubular main body, and to captivate the insulator ring and inner pin contact. McGeary does not teach how the pin might be stored prior to assembly of the connector onto a cable. Nor does McGeary teach a step up pin having tabs or spring fingers for engaging the connector or the center conductor.

U.S. Pat. No. 6,863,565 issued to Kogan, et al. teaches a connector for receiving a mating plug, forming a constant impedance connection. The center conductor of the first plug is supported with a cap attached over a portion of the center conductor that extends beyond the outer conductor portion of the same plug. The mating plug has an outer conductor that projects beyond the inner conductor, and is made to receive the connector or first plug portions. Kogan thus teaches a pin having a larger diameter than the center conductor and supporting the center conductor. Kogan does not discuss securing the pin to the connector prior to assembly in a way that prevents the pin from being lost and that aids assembly of the pin onto the center conductor. Kogan further does not teach a step up pin with an enlarged cable guide portion or spring fingers and tabs for engaging the center conductor or the connector.

U.S. Pat. No. 4,981,445 issued to Bacher, et al. teaches a unitary three-vane support bead with a central conductor having an axial blind bore in each end. The smaller diameter end engages a center conductor of a coax cable. The central conductor is formed in place in the connector. Bacher does not teach a method of securing the pin to the connector prior to assembly in a way that prevents the pin from being lost and that aids assembly of the pin onto the center conductor.

U.S. Pat. No. 4,672,342 issued to Gartzke teaches a coaxial cable connector assembly for connecting coaxial cables of different diameters, the assembly including a center conductor with a large diameter end and a small diameter end. Each end includes spring fingers for engaging the center conductor of a coaxial cable. Gartzke does not discuss securing the pin to the connector prior to assembly in a way that prevents the pin from being lost and that aids assembly of the pin onto the center conductor.

Therefore, a step up pin that is simpler to manage and store, and that provides a simple way to apply the step up pin to the center conductor is desired.

SUMMARY OF THE INVENTION

The invention comprises, in one form, a step up pin for increasing the diameter of a coaxial cable's center conductor. In certain embodiments, the step up pin is used in conjunction with a coaxial cable connector. The step up pin includes a blind bore sized for a tight fit with the center conductor to provide good conduction between the center conductor and the pin. The pin further includes an enlarged cable guide. The pin is stored with the connector until the pin and connector are affixed to a coax cable. In one embodiment, the pin engages a radial through hole in the compression ring of the connector such that the cable guide is outside the ring and the thinner portion of the pin is protected by the compression ring. In use, the coax cable is attached to the connector by inserting the center conductor into the pin through the cable guide, withdrawing the cable and pin from the pin's storage position in the compression ring, and inserting the pin and cable into the axial bore of the connector. The cable guide now engages a cable guide seat, the pin protrudes through the threaded end of the connector, and the outer conductor engages an outer conductor contact. The step up pin now provides better contact with coax cable receptacles than the center conductor would alone.

In an alternative embodiment, the pin is stored in a concentric position with the compression ring with sprue tabs connecting the cable guide to the compression ring. The center conductor is inserted into the pin, an axial or a twisting force is applied to the pin to break the sprue tabs, and the cable is fully inserted into the connector such that the cable guide engages the cable guide seat, the pin protrudes through the threaded end of the connector, and the outer conductor engages the outer conductor contact.

In a further alternative embodiment, the pin is stored outside the connector with one or more sprue tabs connecting the cable guide to the outer surface of the compression ring. In this embodiment, the pin is twisted off for use.

More particularly, the invention includes a step up pin for engaging the center conductor of a coax cable. The step up pin comprises a pin body that defines an axial bore and has a spring finger projecting into the pin body; and a cable guide that has a larger diameter than the pin body and is attached to one end of the pin body. The axial bore of the pin body is a blind axial bore wherein the end of the pin body that the cable guide is attached to is an open end. The cable guide may have a sloped surface for mating with a corresponding surface within a connector body and the pin body may include a tab projecting away from the pin body and directed toward the cable guide.

In another form, the invention includes a method of increasing the diameter of a coax cable center conductor. The method comprises the steps of providing a pin body that defines a blind bore and has a spring finger projecting into the pin body; attaching a cable guide to the pin body; preparing an end of a coax cable; and inserting a center conductor of a coax cable into the pin body such that the spring finger engages the center conductor. The coax cable comprises an outer conductor, a dielectric sleeve between the center conductor and the outer conductor, and a jacket around the outer conductor. The step of preparing the coax cable comprises removing a portion of the jacket to expose the outer conductor, bending a portion of the outer conductor over the remaining jacket, and removing a portion of the dielectric sleeve. The cable guide is attached to the pin body proximate to an open end of the pin body. The pin body includes a tab projecting away from the pin body and is directed toward the cable guide. The method may further include the step of inserting the coax cable into a connector body that has a pin guide and the cable guide and the pin guide may comprise corresponding sloped surfaces where the cable guide engages the pin guide.

In another form, the invention includes a coaxial cable connector that comprises a connector body defining an axial bore for engaging a coaxial cable and a step up pin defining an axial blind bore for engaging a center conductor of a coaxial cable. The step up pin is stored in engagement with the connector body prior to the application of the connector to a coaxial cable. The connector body defines a sidewall bore that has an axis that is substantially perpendicular to the axis of revolution of the connector body, and the step up pin is stored with the connector body in engagement with the sidewall bore. The sidewall bore may be defined when molding the connector body or by machining the connector body. In another embodiment, the step up pin comprising a cable guide that includes one or more breakaway sprue tabs between the cable guide and a compression ring portion of the connector body. The sprue tabs may support the cable guide in a position that is substantially concentric with the compression ring or they may connect the cable guide to an outer wall of the compression ring.

In another form, the invention includes a coaxial cable connector that comprises a connector body having a collar with a nut body engaging one end of the collar and a compression ring engaging the opposing end of the collar; and a step up pin being removably attached to the compression ring, such as through a sidewall bore. The step up pin comprises a pin body and a cable guide that is attached to or integral with the pin body; the pin body defines an axial bore for engaging a center conductor of a coaxial cable. In an alternative embodiment, the step up pin is removably attached to the compression ring by breakaway sprue tabs in a position that is substantially concentric with the compression ring or in a position external to the compression ring.

In another form, the invention includes a method for attaching a connector to a coaxial cable. The method comprises the steps of providing a step up pin in engagement with a coaxial cable connector body, the step up pin defining an axial blind bore and the connector body defining an axial bore; inserting a center conductor of a coaxial cable into the axial blind bore of the step up pin; disengaging the step up pin from the connector body; and inserting the coaxial cable with the step up pin into the axial bore of the connector body. The method may further include the step of drilling a sidewall bore in the connector body, wherein the step up pin engages the sidewall bore. The method may alternatively include the further step of molding a compression ring portion of the connector body, the compression ring being molded with breakaway sprue tabs that support a pin guide. These sprue tabs may be located within the compression ring such that the pin guide is supported in a substantially concentric position with the compression ring or the sprue tabs may extend from an outer wall of the compression ring to support the pin guide externally to the compression ring.

The invention allows the pin to be stored with the connector so that the pin is not easily dropped or lost and such that the pin is easily attached to even small diameter center conductors. Further, because the pin is not fixed within the body of the connector, the user can easily see the opening of the pin for lining up the center conductor.

BRIEF DESCRIPTION OF THE DRAWINGS

The present invention is disclosed with reference to the accompanying drawings, wherein.

Corresponding reference characters indicate corresponding parts throughout the several views. The examples set out herein illustrate several embodiments of the invention but should not be construed as limiting the scope of the invention in any manner.

DETAILED DESCRIPTION

Figure 1:
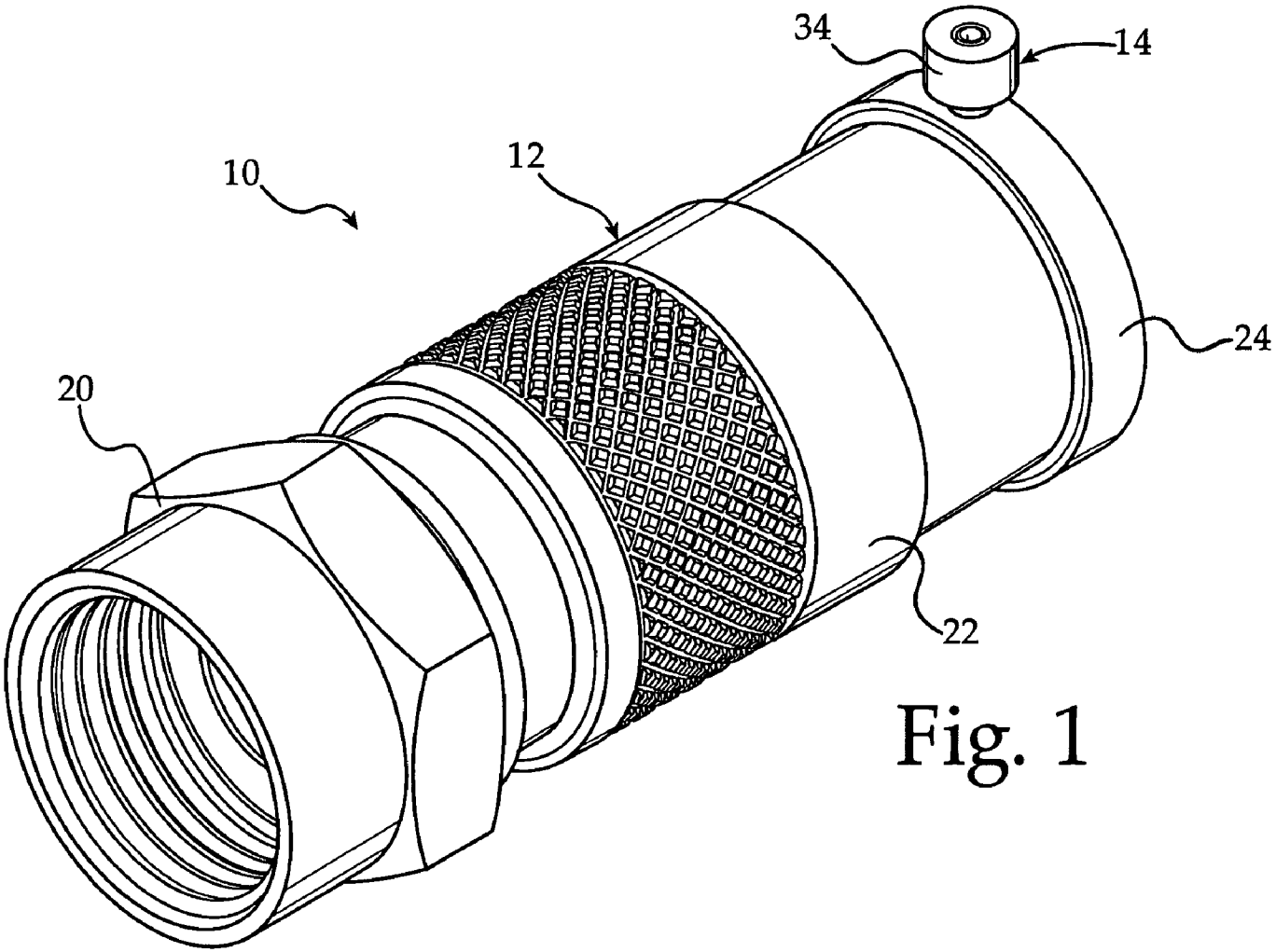
FIG. 1 is an isometric view of a coax cable connector according to the present invention.
Figure 2:
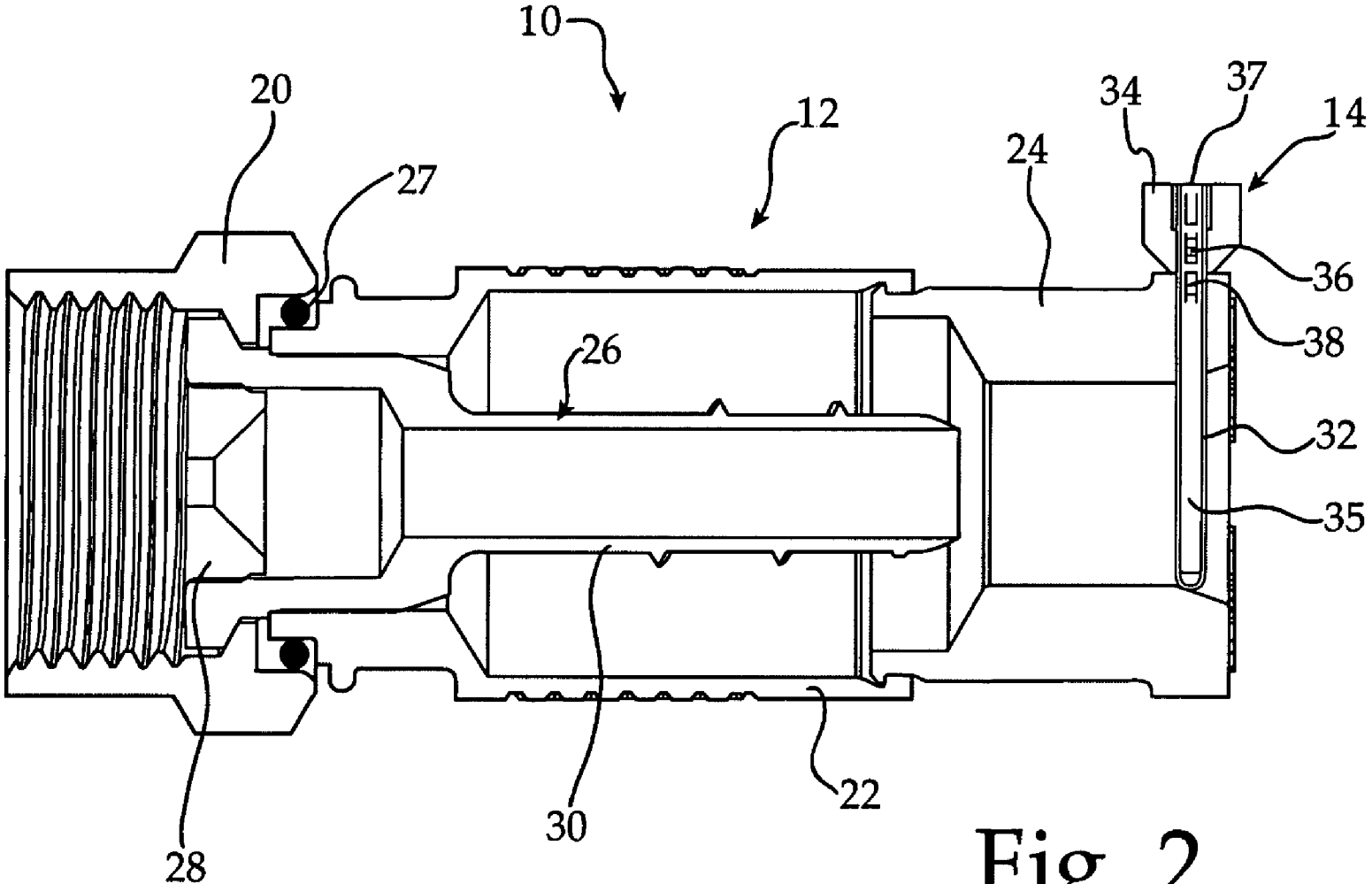
FIG. 2 is a cross-sectional view of the coax cable connector of FIG. 1.

FIG. 1 shows the coax cable connector of the present invention. The connector 10 includes a connector body 12 and a step up pin 14. The connector body 12 includes a nut body 20, a collar 22, a compression ring 24, and an inner post 26 (see FIG. 2). The nut body 20 includes internal threads for connection to an externally threaded coax jack (not shown). The nut body 20 contacts the inner post 26 for electrical connection and engages the collar 22 via an o-ring 27. The collar 22 is knurled or otherwise textured to provide an improved grip on the collar. In its pre-use or storage position, the compression ring 24 is clipped into the end of the collar 22 as shown in FIG. 2. The inner post 26 includes a pin guide 28 and a shaft 30 with barbs for engaging the coax cable's dielectric sleeve.

Figure 3A:
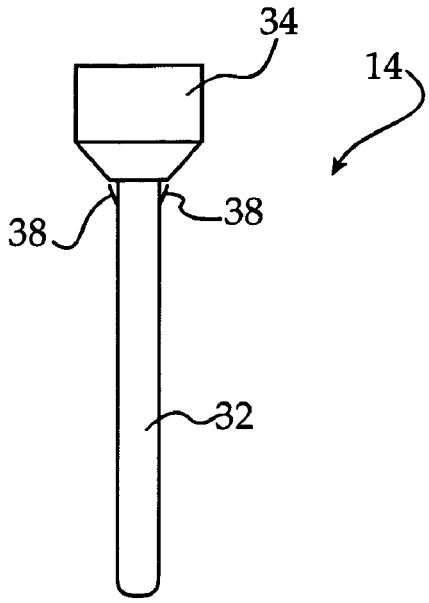
FIGS. 3A-3C are views of the step up pin according to the present invention.
Figure 3B:
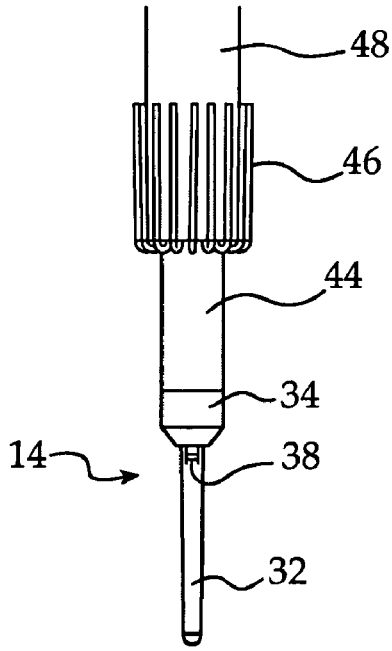
Figure 3C:
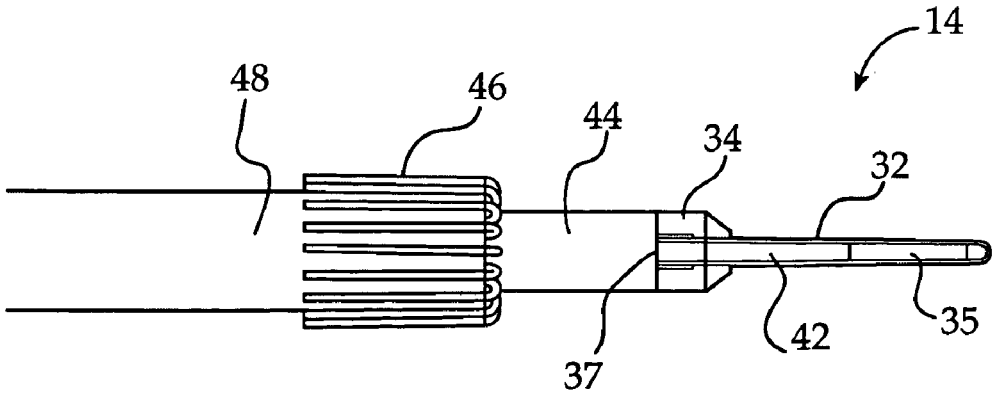

The step up pin 14, which may be used in conjunction with the connector 10 or with any application requiring the increased diameter of the center conductor, includes a pin body 32 and a cable guide 34. The pin body 32, best shown in FIGS. 2 and 3A, includes an axial bore 35 sized for a snug fit with the center conductor of a coax cable. Spring fingers 36 may be included to secure the center conductor within the bore and to improve the conduction between the center conductor and the step up pin 14. The spring fingers 36 project into the pin body 32 and are directed away from the bore opening. As shown, the axial bore 35 is a blind bore with an open end 37. Tabs 38 project outward from the pin body 32, toward the opening of the bore. The cable guide 34 is either integrally formed with the pin body 32 or affixed thereto, such as by an interference fit or an adhesive. The cable guide 34 is complementarily contoured to fit into the slope of the pin guide 28. The outward bias of the tabs 38 assists in retaining the step up pin 14 within the pin guide 28. The step up pin 14 is applied to a coax cable 40 as shown in FIGS. 3A and 3B.

Figure 4A:
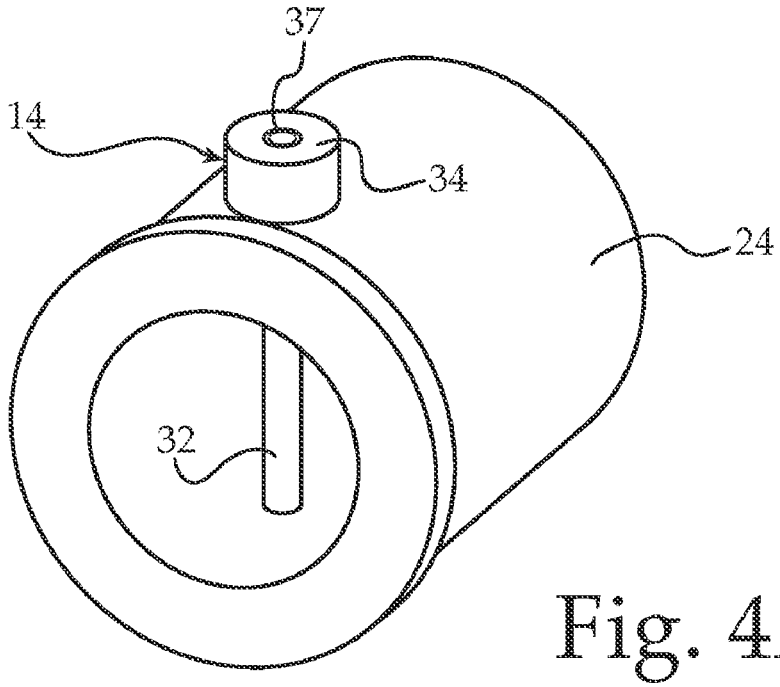
FIG. 4A is an isometric view of the compression ring and step up pin of FIG. 1.
Figure 4B:
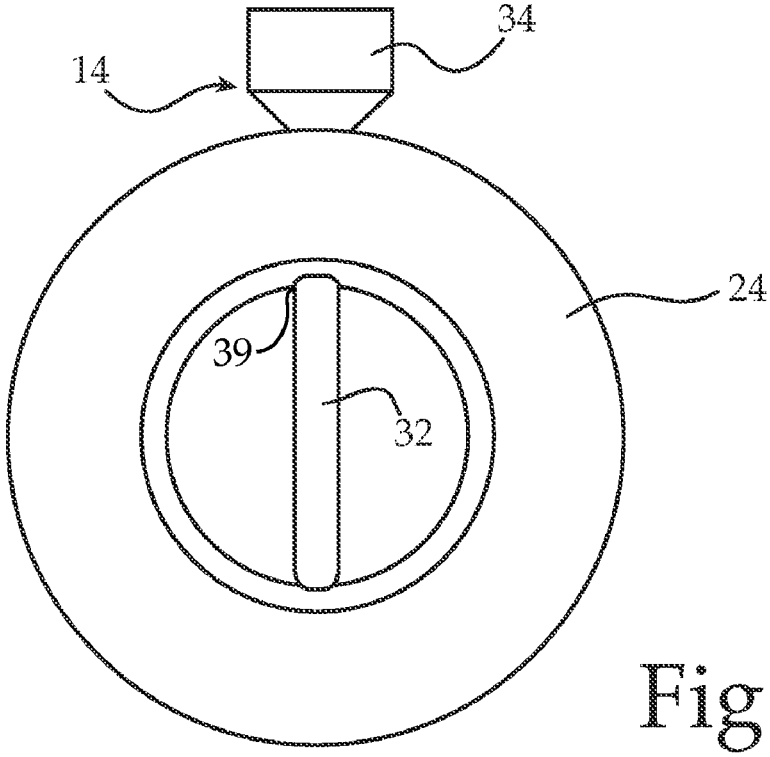
FIG. 4B is an end view of the compression ring and step up pin of FIG. 4A.

As shown in FIGS. 4A and 4B, a sidewall bore 39 is either machined or molded into the compression ring 24 for the storage of the step up pin 14 prior to assembly. The sidewall bore 39 is configured for a snug fit with the pin body 32 to prevent the pin 14 from being separated from the connector body 12. Also, the outward bias of the tabs 38 resists separation of the step up pin 14 and the sidewall bore 39.

Figure 5A:
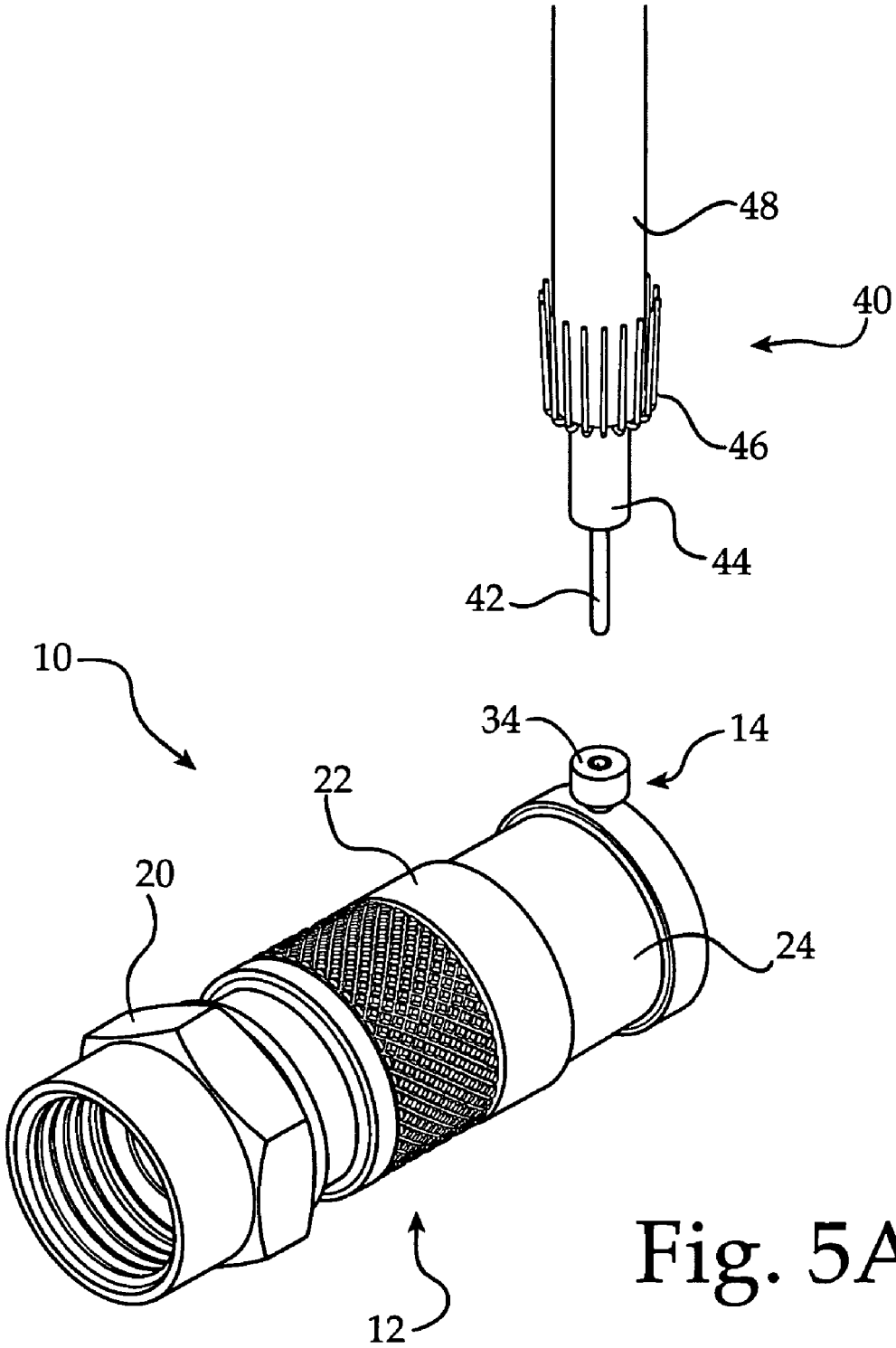
FIGS. 5A-5E are various views of the application of the step up pin and the coax cable connector of FIG. 1 onto a coax cable.
Figure 5B:
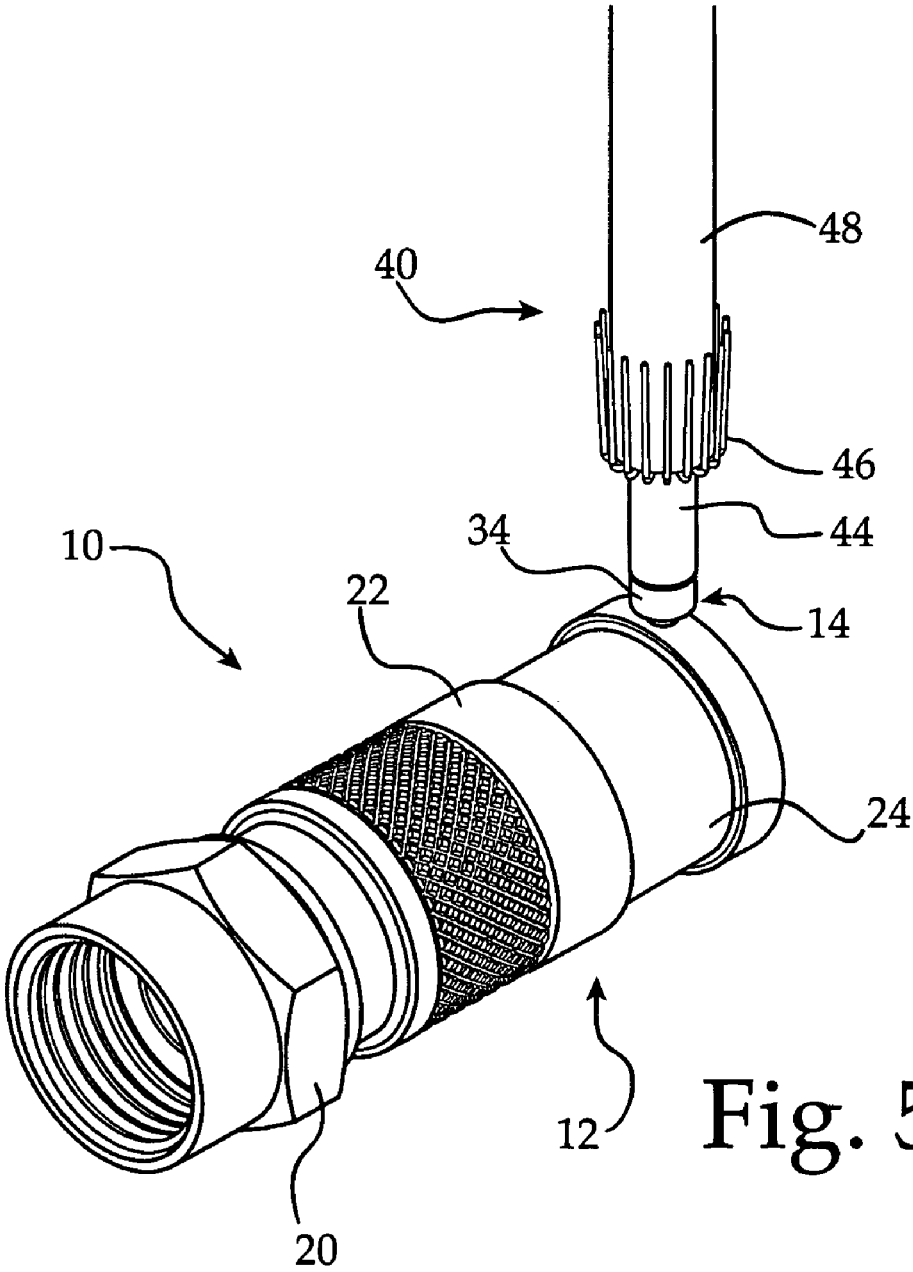
Figure 5C:
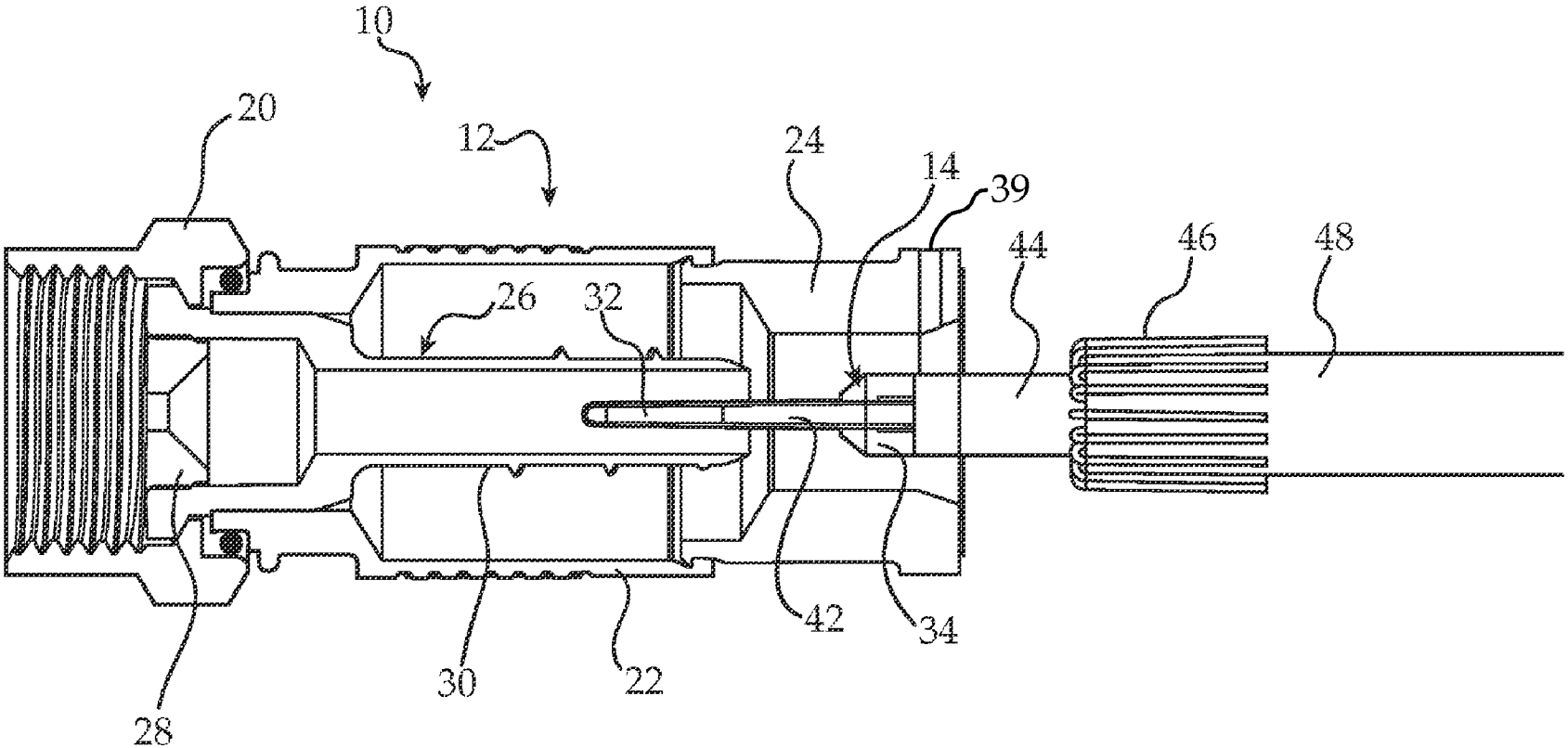

The connector 10 is assembled onto a coax cable as shown in FIGS. 5A-5E. With reference to FIG. 5A, the coax cable 40 is of a known type comprising an electrical central conductor 42, a dielectric sleeve 44, an outer conductor 46, and a jacket 48. The outer conductor 46 may comprise a sheath of fine braided metallic strands, a metallic foil, or multiple layer combinations of either or both. The cable 40 is prepared as usual, such as by exposing about 0.25-in of the center conductor 42 and about 0.25-in of the dielectric sleeve 44 and outer conductor 46 above that. The outer conductor 46 is folded back over the jacket 48. The user inserts the center conductor 42 into the axial bore of the pin body 32 as shown in FIG. 5B. The user then withdraws the cable 40 with the step up pin 14 from the sidewall bore 39 of the compression ring 24 and inserts the cable 40 and step up pin 14 into the axial bore of the compression ring 24 as shown in FIG. 5C.

Figure 5D:
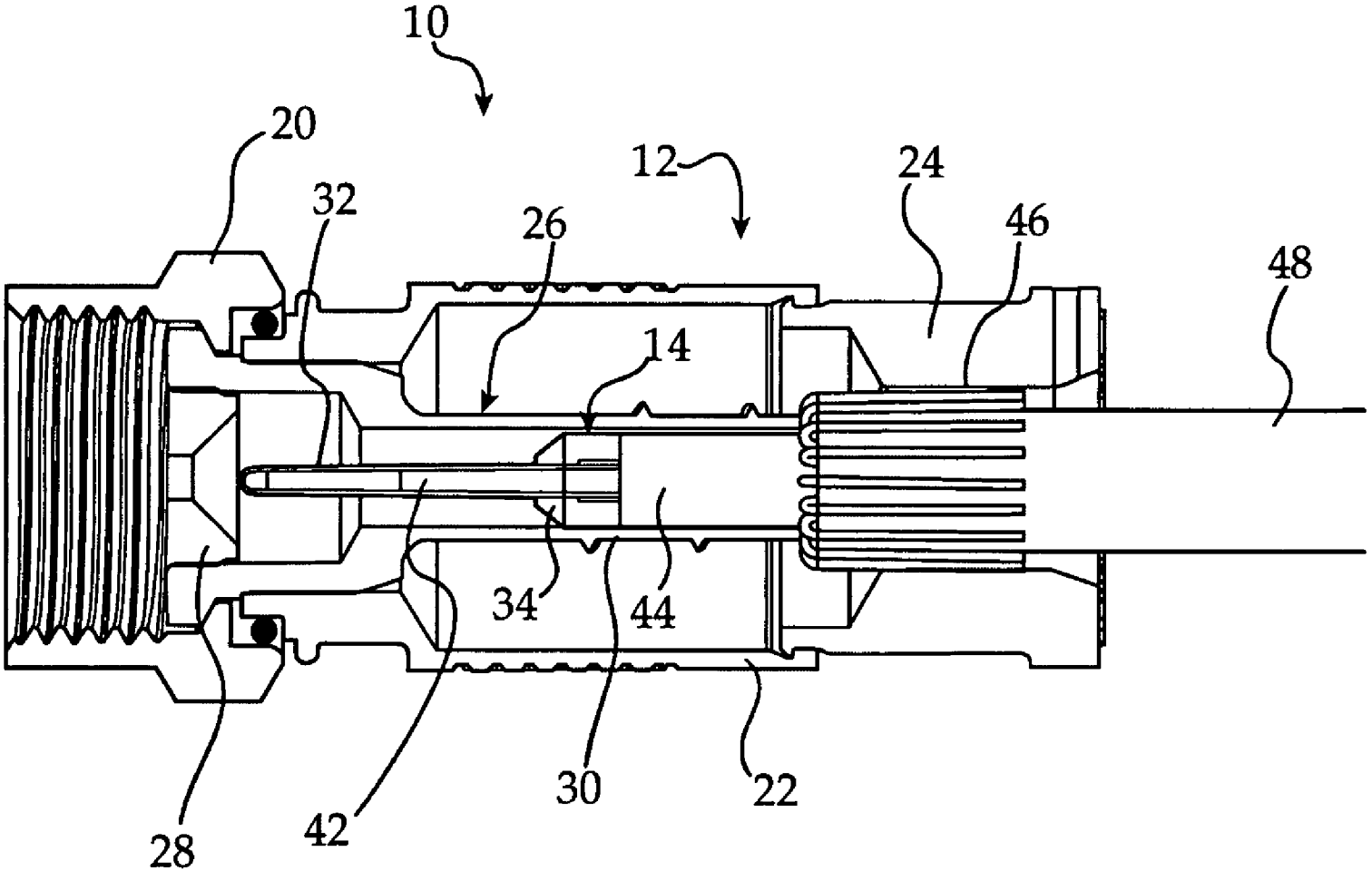
Figure 5E:
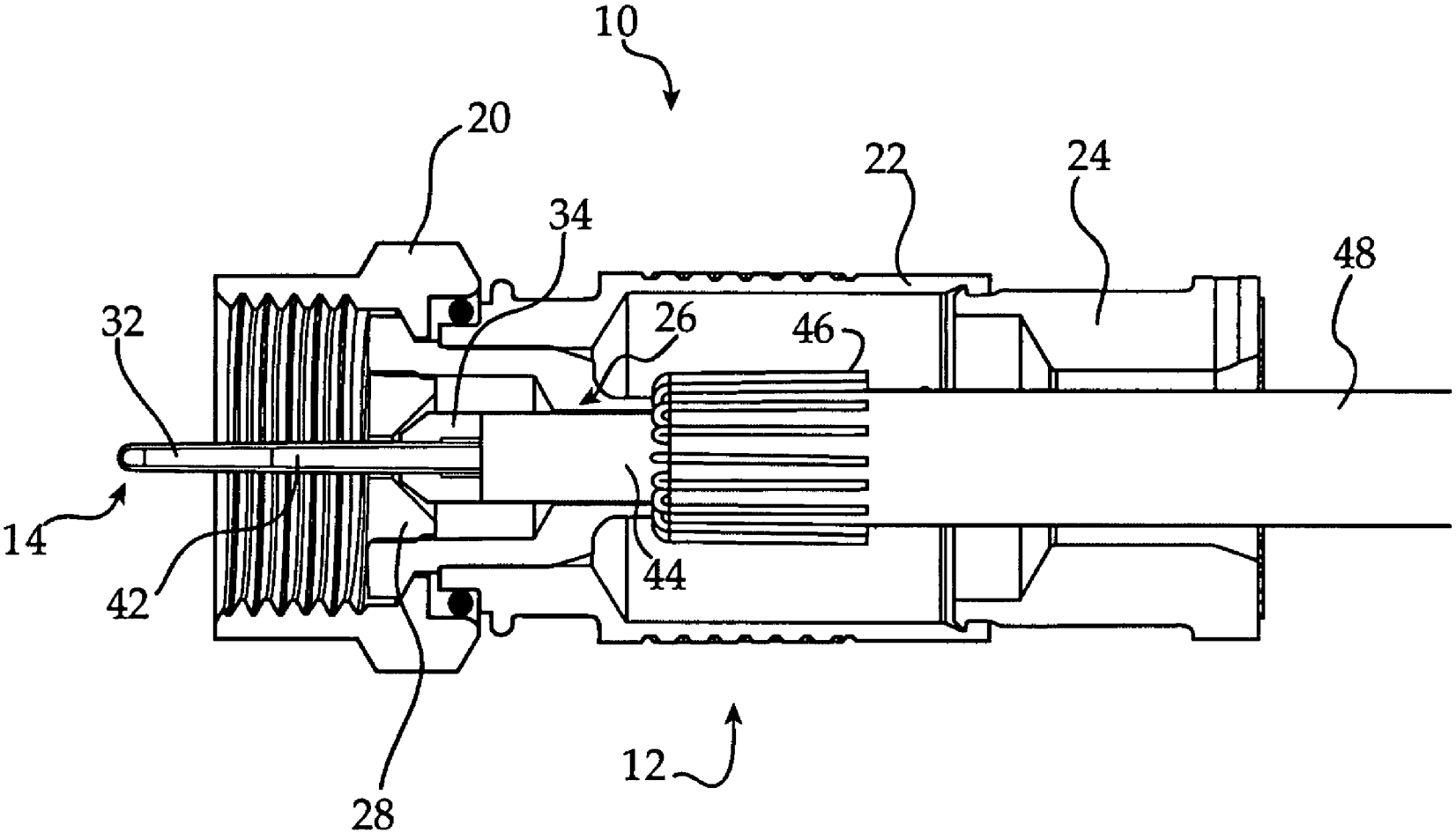

The step up pin 14 and the dielectric sleeve 44 are inserted into the axial bore of the inner post 26 such that the shaft 30 is forced in between the dielectric sleeve 44 and the outer conductor 46 as shown in FIG. 5D. The user continues to direct the cable 40 into the connector body 12 until the cable guide 34 engages the pin guide 28 as shown in FIG. 5E. A compression tool (not shown) forces the compression ring 24 into the collar 22 such that the compression ring 24 compresses the jacket 48 and the outer conductor 46 against the shaft 30 to secure the cable 40 within the connector 10 and to provide good conduction between the outer conductor 46 and the inner post 26.

In use, the connector 10 is attached to a coaxial cable jack (not shown) by inserting the step up pin 14 into an axial bore of the jack and threading the internal threads of the nut body 20 onto corresponding external threads of the jack. An electrical signal is conducted between the center conductor of the jack and the center conductor 42 via the pin body 32. An electrical signal is conducted from the threaded outer conductor of the jack to the nut body 20 and the end of the inner post 26. The inner post 26 conducts the signal to the outer conductor 46. The non-conducting pin guide 28 isolates the inner conductor signal from the outer conductor signal within the connector 10. The cable guide 34 may also be non-conducting.

Figure 6A:
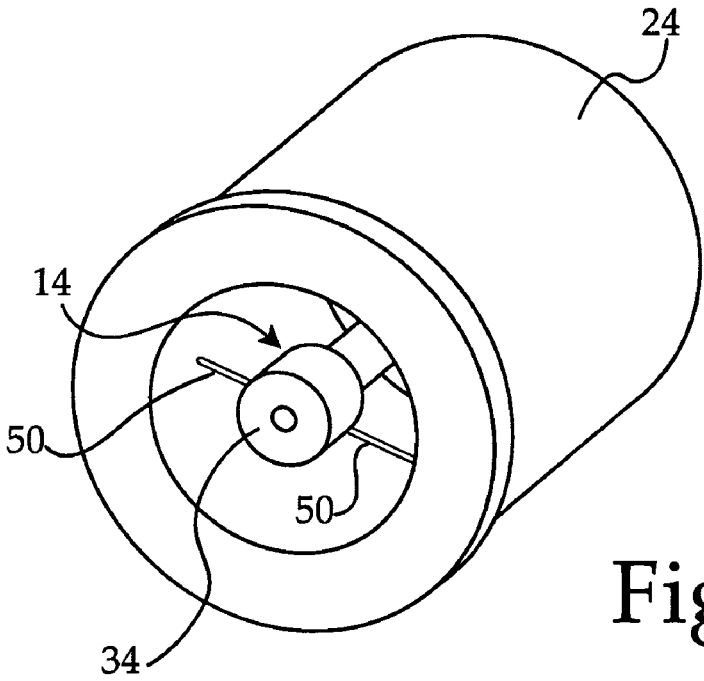
FIG. 6A is an isometric view of the compression ring and step up pin of a second embodiment of the coax cable connector of the present invention.
Figure 6B:
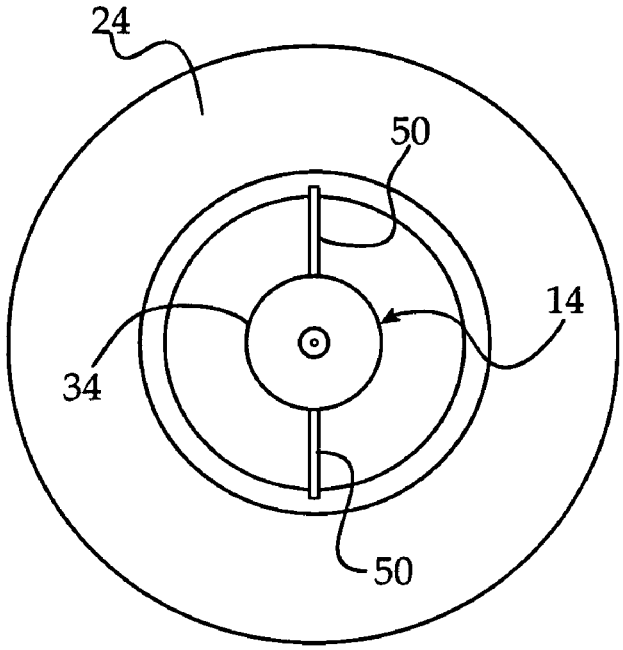
FIG. 6B is an end view of the compression ring and step up pin of FIG. 6A.

In an alternative embodiment, the step up pin 14 is stored in a concentric position within the compression ring 24 as shown in FIGS. 6A and 6B. The step up pin is held within the compression ring 24 by sprue tabs 50. The cable guide 24 is molded with the compression ring 24 with the sprue tabs 50 being formed therebetween. During assembly, the center conductor engages the bore of the ping body 32 and the cable is pushed into the connector body 12 thereby breaking the sprue tabs 50 and driving the step up in 14 to the pin guide 28.

Figure 7A:
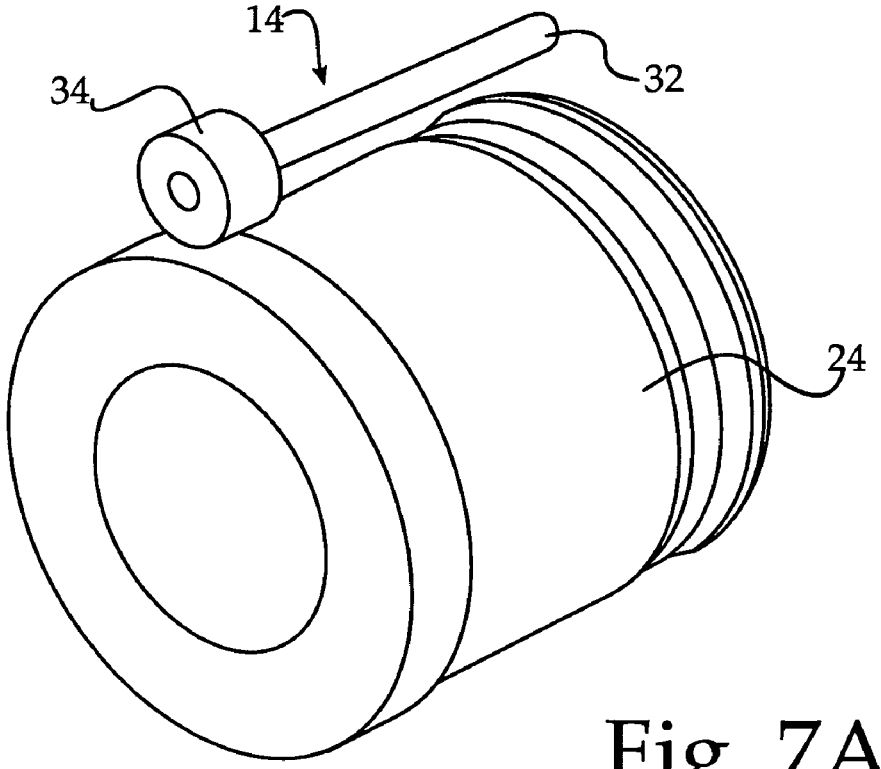
FIG. 7A is an isometric view of the compression ring and step up pin of a third embodiment of the coax cable connector of the present invention.
Figure 7B:
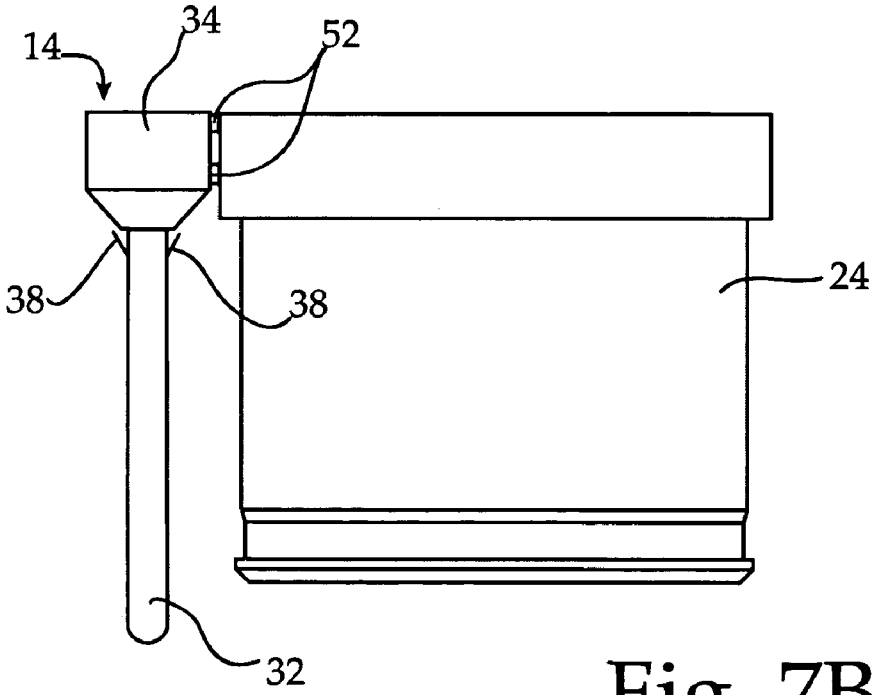
FIG. 7B is an end view of the compression ring and step up pin of FIG. 7A.

In a further alternative embodiment, the step up pin 14 is stored in engagement with the outer surface of the compression ring 24 as shown in FIGS. 7A and 7B. The cable guide 34 is molded with the compression ring 24 with sprue tabs 52 formed therebetween. The connector 10 is assembled onto a coax cable by inserting the center conductor into the bore of the pin body 32 and twisting the step up pin 14 to break the sprue tabs 52 and remove the cable guide 24 from the compression ring 24. The assembly is completed as described above with reference to FIGS. 5C-5E.

It should be particularly noted that the step up pin 14 may have alternative shapes with respect to the cylindrical shape shown. Further, the pin 14 shown in the figures increases the diameter of the center conductor slightly; however, larger increases may be required and are considered within the scope of the invention.

While the invention has been described with reference to preferred embodiments, it will be understood by those skilled in the art that various changes may be made and equivalents may be substituted for elements thereof to adapt to particular situations without departing from the scope of the invention. Therefore, it is intended that the invention not be limited to the particular embodiments disclosed as the best mode contemplated for carrying out this invention, but that the invention will include all embodiments falling within the scope and spirit of the appended claims.

PARTS LIST

10 connector
12 connector body
14 step up pin
20 nut body
22 collar
24 compression ring
26 inner post
27 o-ring
28 pin guide
30 shaft
32 pin body
34 cable guide
35 axial bore of pin body
36 spring fingers
37 open end of pin body
38 tabs
39 sidewall bore of compression ring
40 coax cable
42 central conductor
44 dielectric sleeve
46 outer conductor
48 jacket
50 sprue tabs
52 sprue tabs

The invention claimed is:

1. A coaxial cable connector, comprising:

a) a connector body defining an axial bore for engaging a coaxial cable;

b) a compressor ring defining a sidewall bore, the compressor ring operatively attached to an end of the connector body; and c) a step up pin defining a pin body having an axial blind bore for engaging a center conductor of a coaxial cable, whereby the step up pin is removably engaged to the sidewall bore of the compressor ring prior to the coaxial cable being inserted into the axial bore of the connector.

2. The coaxial cable connector of claim 1, the sidewall bore being defined when molding the connector body.

3. The coaxial cable connector of claim 1, the sidewall bore being defined by machining the connector body.

4. The coaxial cable connector of claim 1, the connector body comprising a molded compression ring.

5. The coaxial cable connector of claim 4, the step up pin comprising a cable guide.

6. The coaxial cable connector of claim 5, the cable guide being an integral portion of the step up pin.

7. A coaxial cable connector, comprising a) an elongated connector body defining an axial bore having a collar with a nut body engaging one end of the collar and a compression ring engaging the opposing end of the collar;

b) a step up pin being removably attached to a sidewall bore defined by the compression ring, wherein the step up pin comprises a pin body and a guide attached to or integral with the pin body, the pin body having an axial blind bore for engaging a center conductor and the pin body configured for inserting into the axial bore of the connector body.

* * * * *